US005130045A

United States Patent [19]

Mitchell et al.

[11] Patent Number: 5,130,045

[45] Date of Patent: * Jul. 14, 1992

[54] DELAYED ONSET ACTIVE OXYGEN BLEACH COMPOSITION

[75] Inventors: Frances E. Mitchell, Pleasanton; David L. deLeeuw, San Ramon, both of Calif.

[73] Assignee: The Clorox Company, Oakland, Calif.

[ * ] Notice: The portion of the term of this patent subsequent to Jul. 14, 2009 has been disclaimed.

[21] Appl. No.: 534,098

[22] Filed: Jun. 5, 1990

Related U.S. Application Data

[63] Continuation of Ser. No. 304,869, Jan. 31, 1989, which is a continuation of Ser. No. 115,269, Oct. 30, 1987, abandoned.

[51] Int. Cl.[5] ..... C11D 3/395

[52] U.S. Cl. ..... 252/102; 252/95; 252/186.1; 252/188.1; 252/528; 252/547

[58] Field of Search ..... 252/94, 95, 98, 99, 252/102, 528, 547, 534, 558, 186.1, 186.25, 186.26, 186.27, 186.3, 186.31, 186.38, 188.1, 188.2

[56] References Cited

U.S. PATENT DOCUMENTS

| | | | |
|---|---|---|---|
| 3,130,165 | 4/1964 | Brocklehurst et al. | 252/99 |
| 3,256,198 | 6/1966 | Matzner | 252/99 |
| 3,265,624 | 8/1966 | Inamorato et al. | 252/99 |
| 3,272,750 | 9/1966 | Chase | 252/99 |
| 3,637,339 | 1/1972 | Gray | 8/111 |
| 3,840,466 | 10/1974 | Gray | 252/99 |
| 3,852,210 | 12/1984 | Krezanoski | 252/95 |
| 3,925,234 | 12/1975 | Hachmann et al. | 252/186 |
| 4,003,841 | 1/1977 | Hachmann et al. | 252/94 |
| 4,088,596 | 5/1978 | Arai et al. | 134/2 |
| 4,166,794 | 9/1979 | Grey | 252/8.8 |
| 4,283,301 | 9/1981 | Diehl | 252/102 |
| 4,367,156 | 1/1983 | Diehl | 252/102 |
| 4,378,300 | 3/1983 | Gray | 252/99 |
| 4,391,723 | 8/1983 | Bacon et al. | 252/90 |
| 4,391,725 | 7/1983 | Bossu | 252/90 |
| 4,412,934 | 11/1983 | Chung et al. | 252/186.38 |
| 4,443,352 | 4/1984 | Broze et al. | 252/94 |
| 4,483,778 | 11/1984 | Thompson et al. | 252/94 |
| 4,486,327 | 12/1984 | Murphy et al. | 252/94 |
| 4,539,130 | 9/1985 | Thompson et al. | 252/186.25 |
| 4,585,150 | 9/1986 | Beachan et al. | 222/129 |
| 4,619,779 | 10/1986 | Hardy | 252/95 |
| 4,654,159 | 3/1987 | Bush et al. | 252/95 |
| 4,655,781 | 4/1987 | Hsieh et al. | 8/111 |
| 4,681,695 | 7/1987 | Divo | 252/94 |
| 4,689,167 | 8/1987 | Collins et al. | 252/99 |

FOREIGN PATENT DOCUMENTS

| | | |
|---|---|---|
| 0062523 | 10/1982 | European Pat. Off. . |
| 68547 | 1/1983 | European Pat. Off. . |
| 0118304 | 9/1984 | European Pat. Off. . |
| 140648 | 5/1985 | European Pat. Off. . |
| 166571 | 1/1986 | European Pat. Off. . |
| 185522 | 6/1986 | European Pat. Off. . |
| 202698 | 11/1986 | European Pat. Off. . |
| 1557568 | 12/1979 | United Kingdom . |

OTHER PUBLICATIONS

J. R. Darwent, Thesis, *Oxidation in Micelles* (1978).

*Primary Examiner*—Hoa Van Le

*Attorney, Agent, or Firm*—Joel J. Hayashida; Michael J. Mazza; Harry A. Pacini

[57] ABSTRACT

Peroxygen bleach compositions which can be used together with oxygen-sensitive wash aids are disclosed. Combination products comprising these bleach compositions together with the oxygen sensitive wash aids are disclosed as well as are methods of laundering employing them. The bleach compositions include a peroxygen source, a surface active or hydrotropic bleach activator or catalyst therefor and a quaternary ammonium salt. As compared to equivalent compositions not containing the quaternary ammonium salt, these bleach compositions are characterized by a delayed onset of active oxygen production when they are added to wash solutions. When these bleach compositions are used in combination with oxygen-sensitive wash aids, the sensitive wash aids have an initial period when they can act before the active oxygen level rises to a level that it interferes with their action. The bleach compositions of this invention which contain the added quaternary ammonium salt are also characterized by achieving higher ultimate levels of active oxygen than do equivalent compositions which do not contain the ammonium salt.

6 Claims, 3 Drawing Sheets

DELAYED ONSET ACTIVE OXYGEN BLEACH COMPOSITION

This is a continuation of application Ser. No. 07/304,869, filed Jan. 31, 1989, now allowed, itself a continuation of Ser. No. 07/115,269, filed Oct. 30, 1987, and now abandoned.

FIELD OF THE INVENTION

This invention relates to improved peroxy laundry bleaching compositions and improved laundry procedures employing the same. More particularly this invention concerns a peroxy bleaching composition which provides increased levels of active oxygen during the wash cycle but also achieves a delayed onset of active oxygen generation.

BACKGROUND OF THE INVENTION

In modern laundry settings, both commercial and domestic, it is increasingly desired to employ a plurality of cleansing aids. These can include soaps and detergents as primary surfactants, and bleaches, whiteners, stain removers and the like to achieve especially good wash performance. Although in some cases it is possible to add these materials sequentially so as to optomize their efficiency, more commonly in a domestic setting they are added at once. This can in some cases lead to antagonistic interactions. In particular, when an enzymatic stain remover is present, its effectiveness can be severely limited if a strong oxidizer which can destroy the enzymes is added. Similarly, a strong oxidizer can attack other wash aids such as fluorescent brighteners or fragrances, if present in the wash mixture.

Peracids, whether added as such or formed in situ from activated peroxygen mixtures, are examples of such oxidizers. Thus, with activated peroxygen bleach systems, it is generally necessary to use these wash aids before or after the peroxygen bleach. This can be an added complication which is not desirable.

Peroxygen bleach systems have been widely used in commercial laundries and are now becoming increasingly common in domestic laundry settings. Peroxygen materials, to be effective, must undergo reaction in the wash liquid to generate an active oxygen species which effects the desired bleaching action by oxidation. Peroxygen bleaches for domestic use include a peroxygen source, most commonly a perborate or the like, and an activator or precursor to promote or catalyze the generation of the active oxygen species. Representative prior patents and literature references to peroxygen bleach and/or the addition of quaternary ammonium materials to laundry preparations include U.S. Pat. No. 4,412,934 of Chung et al;
Great Britain patent 1,557,568 of Procter & Gamble;
U.S. Pat. No. 4,005,029 of Jones;
U.S. Pat. No. 4,290,903 of MacGilp et al;
U.S. Pat. No. 4,397,757 of Bright et al;
U.S. Pat. No. 4,131,562 of Lutz et al;
U.S. Pat. No. 3,852,210 of Kiezanoski;
U.S. Pat. No. 3,475,493 of Diamond et al;
U.S. Pat. No. 3,265,624 of Inamorato;
U.S. Pat. No. 4,378,300 of Grey;
U.S. Pat. No. 4,443,352 of Broze et al;
U.S. Pat. No. 4,430,244 of Broze et al;
U.S. Pat. No. 4,079,015 of Paucot et al;
U.S. Pat. No. 3,130,165 of Brocklehurst et al; and

*Journal of Chemical Education*, Vol 55, No. 7, July 1978, page 429–433.

Representative disclosures of a percompound together with an activator and an enzyme include U.S. Pat. No. 3,637,339 and U.S. Pat. No. 3,840,466, both of Gray. An additional reference to Grey is U.S. Pat. No. 4,166,794, issued Sept. 4, 1979. The patent discloses and claims a liquid bleach/softener composition consisting essentially of a water soluble peroxy bleaching agent (of which at least 50% is hydrogen peroxide) and a water-soluble fabric softener compound (at least 50% cationic amino softener), and the balance, water, or a mixture of water and alcohol.

The reference states that bleaching agents useful in the composition include hydrogen perioxide and alkaline metal perborates, which can be activated. Also, the fabric softening compounds include aliphatic quaternary ammonium compounds, preferably hexadecyltrimethyl ammonium bromide.

In contrast with the invention contemplated in the present application, this reference does not appear to teach surface active activators to produce surface active peracids.

Also of interest is EP 140 648 (published May 8, 1985). It discloses hydrogen peroxide compositions which are contented to contain an emulsion with one part by weight emulsifier per part by weight of activator (enol ester). This reference relies on specific enol ester activators and requires at least an equal weight amount of emulsifier.

It is a general object of this invention to provide a peroxygen bleaching composition which can be added to a laundry mixture together with oxygen-sensitive wash aides and not destroy the effectiveness of such wash aids.

It is an additional object of this invention to provide a combination product which includes a peroxygen bleach and an oxygen-sensitive wash aid.

STATEMENT OF THE INVENTION

The present invention now provides peroxygen bleach compositions which can be used together with oxygen-sensitive wash aids. These bleach compositions include a peroxygen source, a surface active or hydrotropic bleach activator or catalyst and a quaternary ammonium salt. As compared to equivalent compositions not containing the quaternary ammonium salt, these bleach compositions are characterized by a delayed onset of active oxygen production when they are added to wash solutions. When these bleach compositions are used in combination with oxygen-sensitive wash aids, the sensitive wash aids have an initial period when they can act before the active oxygen level rises to levels that could interfere with their action.

The bleach compositions of this invention which contain the added quaternary ammonium salt are also characterized by achieving higher ultimate yields or levels of active oxygen than do equivalent compositions which do not contain the ammonium salt.

In one aspect, this invention provides a bleach composition which includes a peroxygen compound, a surface active or hydrotropic bleach activator and a quantity of quaternary ammonium salt sufficient to beneficially delay formation of peracid.

In an additional aspect, this invention provides a combination laundry product which includes a peroxygen bleach made up of a peroxygen compound, a surface active or hydrotropic bleach activator and a quaternary ammonium salt together with an oxygen-sensitive wash aid.

In a preferred aspect, this invention provides a combination laundry product which includes a peroxygen bleach made up of a peroxygen compound, a surface active or hydrotropic bleach activator and a quaternary ammonium salt together with an enzymatic wash aid.

In an additional aspect, this invention provides an improved method of laundering which involves forming an aqueous solution of the combination product described above and immediately contacting clothes in need of bleaching and whitening with the solution through an initial period during which the oxygen-sensitive wash aid is active in the solution and can achieve a whitening effect on the clothes and through a subsequent period during which the peroxygen bleach components of the combination product provide an effective bleaching level of active oxygen to the solution.

Detailed Description of the Invention

BRIEF DESCRIPTION OF THE DRAWINGS

In this specification, reference will be made to the accompanying drawings in which the three figures are graphs illustrating the delayed onset of active oxygen generation as well as the ultimately increased levels of active oxygen generation which are achieved when employing the present invention.

DESCRIPTION OF PREFERRED EMBODIMENTS

Figure 1:
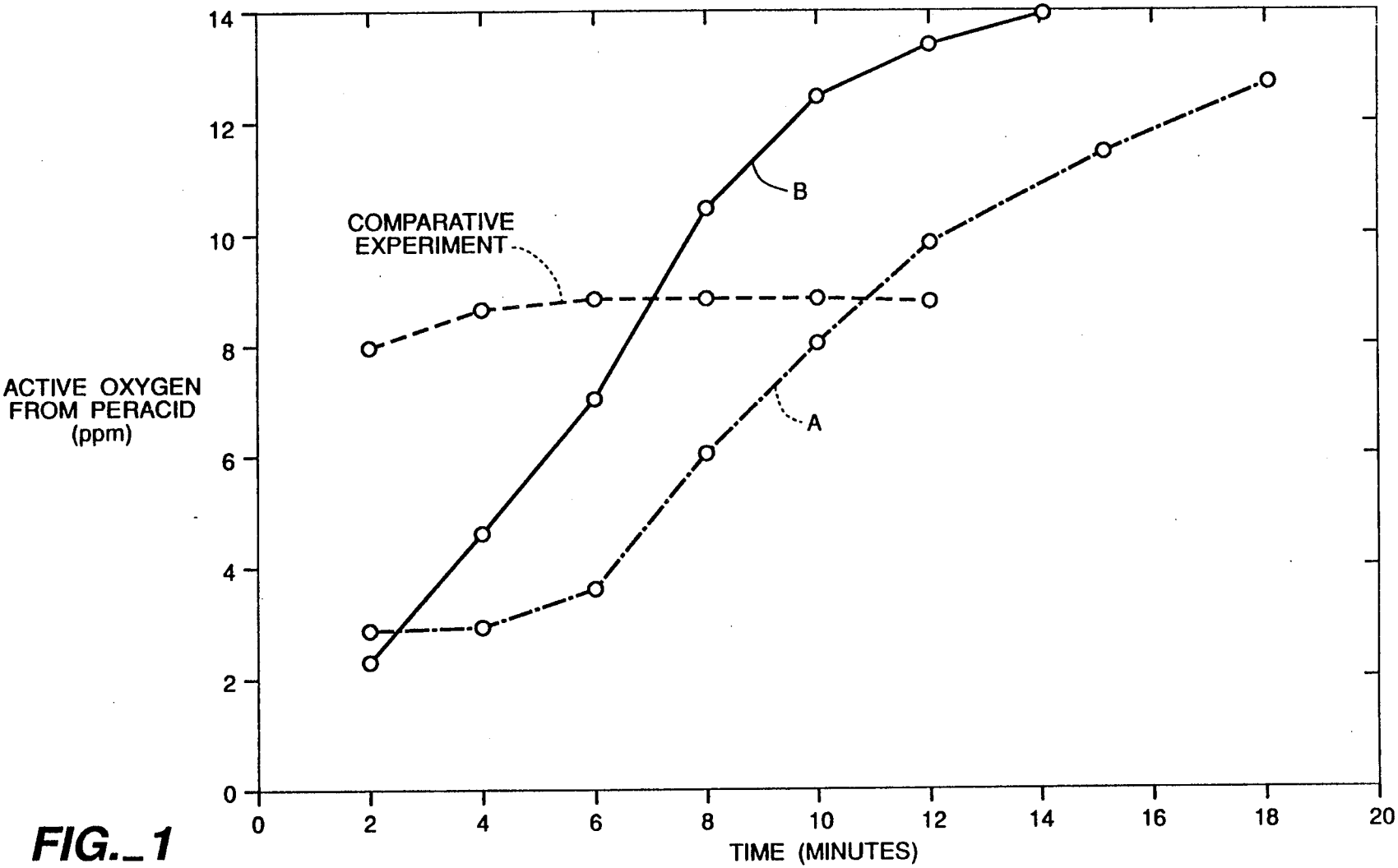

This description is presented in the following sections:

The Quaternary Ammonium Salts
The Peroxygen Materials
The Activators
The Oxidation Sensitive Wash Aids
Optional Ingredients
The Overall Compositions
Typical Use Conditions
Examples

The Quaternary Ammonium Salt

The quaternary ammonium materials employed in the present compositions are quaternary ammonium salts, most commonly available as halides, especially chlorides. These materials are represented by the structural formula

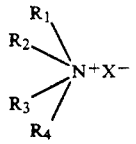

wherein $X^-$ is an anion, most commonly a halide such as chloride, bromide or the like and preferably a chloride or a bromide; $R_1$ through $R_4$ are organic groups, preferably hydrocarbyls including saturated and unsaturated alkyls of from 1 to 25 carbon atoms, aryls of 6 or 10 carbon atoms and alkaryls and aralkyls of from 7 to 12 carbon atoms. Thus, typical alkyl R groups can include methyl, ethyl, isopropyl, n-butyl and t-butyl, octyl, dodecyl, hexadecyl, octadecyl, eicosyl and the like as well as similar materials containing one or two olefinic linkages. Similarly, typical aryls can be phenyl or naphthyl groups; while typical aralkyls can include benzyl, methyl- or ethylbenzyls and the like; and alkaryls can include methylphenyl, t-butylphenyl and the like. It is also possible for the R groups to be materials which are supplied as mixtures or are defined as reaction products. For example, an R could be a mixed 6 to 8 carbon alkyl, a mixed 6 to 10 carbon alkyl, mixed 8 to 12 carbon alkyl, a mixed 12 to 16 carbon alkyl, a tallow derivative such as hydrogenated tallow, or the like. In preferred materials, at most, one of the R groups contains an aryl ring. Also in preferred materials, at least one of the R groups is a saturated or unsaturated alkyl of 4 or more carbon atoms or such an aryl-containing material.

The following are representative quaternary ammonium materials which can be used in the present invention:

methyl tri($C_{8-10}$) alkyl ammonium chloride,
trimethyl ($C_{8-10}$) alkyl ammonium chloride,
dimethyl di($C_{8-10}$) alkyl ammonium chloride,
tetrabutyl ammonium bromide,
methyl tributyl ammonium chloride,
dimethyl dibutyl ammonium chloride,
benzyl trimethyl ammonium chloride,
benzyl octyl dimethyl chloride,
trimethyl dodecyl ammonium chloride,
trimethyl coco ammonium chloride,
dimethyl dicoco ammonium chloride,
trimethyl octadecyl ammonium chloride,
trimethyl stearyl ammonium chloride,
trimethyl cetyl ammonium chloride,
dimethyl ethyl stearyl ammonium chloride,
trimethyl hexadecyl ammonium chloride,
trimethyl hydrogenated tallow ammonium chloride,
dimethyl dihydrogenated tallow ammonium chloride,
dimethyl ditallow ammonium chloride,
trimethyl tallow ammonium chloride,
dimethyl diisoya ammonium chloride,
trimethyl isoya ammonium chloride, and the like.

These materials are available commercially from sources such as Armak Industrial Chemicals Division, Chicago, Ill. and Sherex Chemical Company, Dublin, Ohio. These and other materials falling within the definitions set forth herein can also be prepared by conventional processes well known to the art.

Among the quaternary ammonium salts, preference is given to salts having three 1 to 3 carbon alkyls and one 4 to 25 carbon alkyl with a total number of carbon atoms being between 8 and 28, with special preference being given to alkyl trimethyl ammonium halides wherein the alkyl group is from 4 to 25 carbons and especially those wherein the alkyl group is from 8 to 16 carbons, inclusive.

An advantage of the present invention is that the addition of the quaternary ammonium compound not only delays but also enhances the generation of active oxygen species. This is in contrast to the teaching of U.S. Pat. No. 4,391,723 of Bacon, et al to the effect that one can add a bleach release delaying amount of surfactant (such as soap) to a pouched peracid and enzyme product and by so doing improve the performance of the enzyme component.

The present invention avoids the use of pre-formed peracids with their inherent instability and, at the same time, leads to enhanced perhydrolysis not suggested in the art.

The Peroxygen Materials

The present invention involves wash systems which contain a source of active oxygen. Such sources of active oxygen include a peroxygen material and a peracid-forming activator or catalyst.

The peroxygen material can be hydrogen peroxide, an $H_2O_2$ adduct such as a peroxy solid such as an alkali metal (i.e. potassium or sodium) percarbonate, perpolyphosphate, persilicate, or perborate or mixtures thereof which is capable of releasing hydrogen peroxide into aqueous solution. Of these materials, the alkali metal perborates (anhydrous, mono- and tetrahydrated) are usually preferred because of their commercial availability and relatively low cost.

If liquid hydrogen peroxide is the peroxygen material, it may be necessary to keep it separated from the activator prior to addition to the wash liquid, so as to avoid premature decomposition and generation of active oxygen.

An example of a practical execution of a liquid delivery system is to dispense separately metered amounts of the precursor (in some nonreactive fluid medium) and liquid hydrogen peroxide in a container such as described in Beacham et al, U.S. Pat. No. 4,585,150, commonly assigned to The Clorox Company, and incorporated herein by reference.

The Activators

The bleach activators, also known as peracid precursors, employed are those organic peracid-forming compounds disclosed in the art for use in conjunction with such peroxide sources. The organic peracid precursors are typically compounds containing one or more acyl groups which are susceptible to perhydrolysis. The preferred activators are those of the N-acyl or O-acyl compound type containing an acyl radical R—CO— wherein R is an aliphatic group having from 5 to 18 carbon atoms, or alkylaryl of about 11 to 24 atoms, with 5 to 18 carbon atoms in the allyl chain. If the radicals R are aliphatic, they preferably contain 5 to 18 carbon atoms and most preferably 5–12 carbon atoms. These types of surface active activators would provide surface active or hydrotropic peracids. Surface active peracids are generally classified as those peracids which can, similar to surfactants, form micelles in aqueous media. See U.S. Pat. No. 4,655,781, of Hsieh et al, of common assignment and incorporated herein by reference. An alternative definition is hydrophobic peracid, which is defined as one "whose parent carboxylic acid has a measurable CMC (critical micelle concentration) of less than 0.5M." See European Published Application EP 68 547; U.S. Pat. No. 4,391,725, of Bossu, both of which are incorporated herein by reference. Such peracids are particularly desirable for cleaning performance on fatty or oily soil and stains such as sebum and grease.

Another way of defining appropriate activators is to describe such activators' acyl portion as being the acyl moiety of a carboxylic acid having a log $P_{oct}$ of from about 1.9 to about 4.1, where $P_{oct}$ is the partition coefficient of the carboxylic acid between n-octanol and water at 21° C. This is described in A. Leo et al in *Chemical Reviews*, pp. 525–616 (1971) and in U.S. Pat. No. 4,536,314, of Hardy et al, at column 4, lines 20–27 and at lines 41–51, both of which are incorporated herein by reference.

Hydrotropic peracids are defined as those "whose parent carboxylic acid has no measurable CMC below 0.5M" as set forth in EP 68547; U.S. Pat. No. 4,391,725, of Bossu, both of which are incorporated herein by reference. An example of a bleach activator which can deliver a hydrotropic peracid is shown in Diehl, U.S. Pat. Nos. 4,283,301 and 4,367,156, namely:

$$\underset{\underset{O}{\|}}{Z}CR'\underset{\underset{O}{\|}}{C}Z,$$

wherein R' is a hydrocarbyl of 4–24 carbons, optionally ethoxylated, and each Z is a leaving group selected from enols, carbon acids and imidazoles.

R may be unsubstituted or substituted with $C_{1-3}$ alkoxy groups, halogen atoms, nitro or nitrilo groups. Aromatic radicals, in particular, may be chloro and/or nitro substituted.

Activators also contain leaving groups which are displaced during the perhydrolysis as a result of attack upon the activator by perhydroxide ion from the peroxygen source. Generally, to be an effective leaving group it must exert an electron-attracting effect. This facilitates the attack by the peroxide ion and enhances the production of the desired peracid. Such groups generally have conjugate acids with pKas in the range of from about 6 to about 13. These leaving groups can be selected broadly from among enols, carbon acids, N-alkyl quaternary imidazoles, benzoxys, and the like.

Examples of typical suitable surface active activators coming within this definition include, for example:

(a) Carbonyl materials of the formula $$R-\overset{\overset{O}{\|}}{C}-L$$

such as disclosed in U.S. Pat. No. 4,412,934 where R is an alkyl group of up to about 18 carbon atoms and L is a leaving group having a conjugate acid with a pKa in the range of 6 to 13. These types of activators were previously disclosed in U.K. patent 864,798.

(b) Activators of the general structure $$R-\overset{\overset{O}{\|}}{C}-Z,$$

wherein R is an alkyl chain containing about 5 to 13 carbon atoms, and Z is a leaving group selected from enols, carbon acids and imidazoles, as exemplified in U.S. Pat. Nos. 4,283,301 and 4,367,156, both of Diehl.

(c) Alpha-substituted alkyl or alkenyl esters of the general structure $$R-\underset{\underset{R^1}{|}}{\overset{\overset{X'}{|}}{C}}-\overset{\overset{O}{\|}}{C}-L,$$

wherein R is a straight or branched alkyl or alkenyl group having from about 4 to 14 carbon atoms, R' is H or $C_2H_5$, X is Cl, $OCH_3$ or $OC_2H_5$ and L is a leaving group selected from substituted benzenes, amides, carbon acids, imidazoles, enol esters, and sugar esters, exemplified by U.S. Pat. No. 4,483,778 of Thompson et al, and U.S. Pat. No. 4,486,327, of Murphy et al.

(d) Activators of the general structure $$[RX]_mAL,$$

wherein R is a hydrocarbyl or alkoxylated hydrocarbyl group, preferably $C_{6-20}$ alkyl; X is a heteroatom selected from O, $SO_2$, $N(R')_2$, $P(R')_2$, $(R')P{-}{>}O$ or $(R')N{-}{>}O$; when m=1, A is

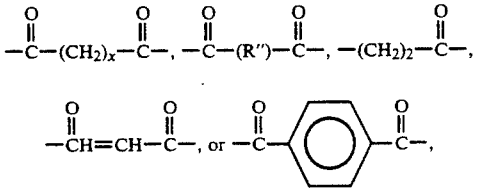

and X is 0 to 4, Z is 0 to 2, (R') is alkyl and R'' is branched-chain alkylene; when m=2, A is

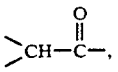

such activators being exemplified in European Published Patent Application EP 166,751;

(e) Carbonate esters of the general structure

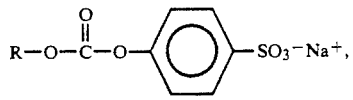

wherein R is $C_{6-10}$ alkyl, such as disclosed in European Published Patent Application EP 202,698 (also apparently disclosed in U.S. Pat. Nos. 3,272,750, of Chase, 3,256,198, of Matzner, and 3,925,234and 4,003,841, both of Hachmann et al.)

(f) Substituted phenylene mono- and diester activators of the general structure:

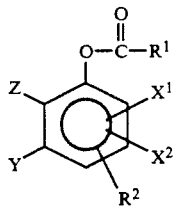

wherein $R^1$ is preferably $C_{4-17}$ alkyl, $R^2$ is OH,

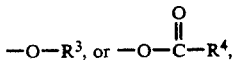

and $X^1$, $X^2$, Y and Z are substituents, as exemplified in European Published Patent Application EP 185,522, of common assignment herein.

Each of the foregoing references listed in subparagraphs (a) through (f) above are incorporated herein by reference.

The Oxidation-Sensitive Wash Aids

The compositions of this invention offer the advantage of a delayed onset of active oxygen generation. This makes them attractive for use in conjunction with oxygen-sensitive wash aides.

Representative wash aids include enzymatic stain removers. Such materials include enzymes capable of hydrolyzing substrates, e.g., stains. Under the International Union of Biochemistry, accepted nomenclature for these types of enzymes is hydrolases. Hydrolases include, but are not limited to, proteases, amylases (carbohydrases), lipases (esterases), cellulases, and mixtures thereof. Proteases, especially so-called alkaline proteases, are commonly employed as wash aids, since they attack protein substrates and digest them, e.g., troublesome stains such as blood and grass.

Commercially available alkaline proteases are derived from various strains of the bacterium *Bacillus subtilis*. These proteases are also known as subtilisins. Nonlimiting examples thereof include the proteases available under the trademarks Esperase®, Savinase®, and Alcalase®, from Novo Industri A.S., of Bagsvaerd, Denmark; those sold under the trademarks Maxatase® and Maxacal® from Gist-Brocades N.V. of Delft, Netherlands; and those sold under the trademark Milezyme® APL, from Miles Laboratories, Elkhart, Ind. Mixtures of enzymes are also included in this invention. See also U.S. Pat. No. 4,511,490, issued to Stanislowski et al, incorporated herein by reference. These commercially available proteases are supplied in prilled, powdered, or comminuted forms. These enzymes can include a stabilizer, such as triethanolamine, clays, or starch.

Other enzymes may also benefit from the practice of the invention. Thus, lipases, which digest fatty substrates, and amylases, which digest starch substrates, can be used in the compositions. These two types of enzymes are available commercially. Lipases are described in U.S. Pat. No. 3,950,277, column 3, lines 15–55, the description of which is incorporated herein by reference. Suitable amylases (and their sources) include Rapidase® (Societe Rapidase, France), Maxamyl® (Gist-Brocades), Termamyl® (Novo Industri), and Milezyme® DAL (Miles Laboratories). Cellulases may also be desirable for incorporation and description of exemplary types of cellulases is found from the specifications of U.S. Pat. No. 4,479,881, issued to Tai; U.S. Pat. No. 4,443,355, issued to Murata et al; U.S. Pat. No. 4,435,307, issued to Barbesgaard et al; and U.S. Pat. No. 3,983,002, issued to Ohya et al, all of which are incorporated herein by reference.

Another class of wash aid which can benefit from the practice of the invention is the fluorescent whiteners or optical brighteners although, as a rule these materials take effect more quickly than enzyme stain removers and thus are less prone to attack by rapid onset of active oxygen. Representative fluorescent whitening agents include the naphtholtriazol stilbene and distyryl biphenyl fluorescent whitening agents sold by the Ciba-Geigy Corporation under the names Tinopal® RBS and Tinopal® CBS-X respectively, and the stilbene materials also marketed by Ciba-Geigy under the name Tinopal® 5BMX. Other useful whiteners are disclosed in columns 3, 4, and 5 of U.S. Pat. No. 3,393,153 and further useful whiteners are disclosed in ASTM publication D-553A, *List of Fluroescent Whitening Agents for the Soap and Detergent Industry*, which disclosures are incorporated herein by reference.

Yet another class of wash aids which can benefit are the fragrances which can be selected from materials of the art.

Optional Ingredients

The compositions of this invention may, if desired, contain additional components such as buffers, colorants, primary cleansing agents (surfactants), detergency builders and bulking agents. In addition, peroxide stabilizers, such as heavy metal chelating ligands, for example EDTA, can be added, if desired.

Colorants can be selected from materials of the art.

Representative surfactants include conventional nonionic, ampholytic and zwitterionic surfactant materials as are described in the art. Examples of suitable surfactants for use in these formulations may be found in Kirk-Othmer, *Encyclopedia of Chemical Technology*, 3rd Edition, volume 22, pages 247–387 (1983) and McCutcheon's *Detergents and Emulsifiers*, North American Edition (1983). These two disclosures are incorporated herein by reference. One generally preferred group of surfactants are the nonionic surfactants such as are described at pages 360–377 of Kirk-Othmer. Nonionic materials include alcohol ethoxylates, alkyl phenol ethoxylates, carboxylic acid esters, glycerol esters, polyoxyethylene esters, anhydrosorbitol esters, ethoxylated anhydrosorbitol esters, ethoxylates of natural fats, oils and waxes, glycol esters of fatty acids. carboxylic amides, diethanolamine condensates, monoalkanolamine condensates, polyoxyethylene fatty acid amides, polyalkylene oxide block copolymers, poly(oxyethylene-co-oxypropylene) nonionic surfactants and the like. A wide range of such materials are available commercially, including the Shell Chemical Neodols ®, the Union Carbide Tergitols ®, the ICI Tween's ® and Spans ® and the like.

Detergency builders which may optionally be added to the bleach compositions can be selected from the detergency builders commonly added to detergent formulations. Useful builders include any of the conventional inorganic and organic water-soluble builder salts. Useful inorganic builder salts include, for example, water-soluble salts of phosphates, pyrophosphates, orthophosphates, polyphosphates, silicates, carbonates, and the like. Organic builders include water-soluble phosphonates, polyphosphonates, polyhydroxysulfonates, polyacetates, carboxylates, polycarboxylates, succinates, and the like.

Specific examples of inorganic phosphate builders include sodium and potassium tripolyphosphates, pyrophosphates, and hexametaphosphates. The organic polyphosphonates specifically include, for example, the sodium and potassium salts of ethane-1-hydroxy-1,1-diphosphonic acid and the sodium and potassium salts of ethane-1,1,2-triphosphonic acid. Examples of these and other phosphorous builder compounds are disclosed in U.S. Pat. Nos. 3,213,030; 3,422,021; 3,422,137; and 3,400,176. Pentasodium tripolyphosphate and tetrasodium pyrophosphate are especially preferred water-soluble inorganic builders.

Specific examples of nonphosphorous inorganic builders include water-soluble inorganic carbonate, bicarbonate, and silicate salts. The alkali metal, for example, sodium and potassium, carbonates, bicarbonates, and silicates are particularly useful herein.

Water-soluble organic builders are also useful. For example, the alkali metal, ammonium and substituted ammonium polyacetates, carboxylates, polycarboxylates, and polyhydroxysulfonates are useful builders for the compositions and processes of the invention. Specific examples of polyacetate and polycarboxylate builders include sodium, potassium, lithium, ammonium, and substituted ammonium salts of ethylene diaminetetraacetic acid, nitrilotriacetic acid, benzene polycarboxylic (i.e., penta- and tetra-) acids, carboxymethoxysuccinic acid and citric acid.

Water-insoluble builders may also be used, particularly the complex sodium alumino silicates such as zeolites, e.g., zeolite 4 A, a type of zeolite molecular sieve wherein the univalent cation is sodium and the pore size is about 4 Å. The preparation of such type zeolite is described in U.S. Pat. No. 3,114,603. The zeolite may be amorphous or crystalline and have waters of hydration as is known in the art.

Fillers or bulking agents may also be included in the bleaching compositions of the invention. A preferred filler salt is an alkali metal sulfate, such as potassium or sodium sulfate, the latter being especially preferred.

The Overall Compositions

The overall composition of the bleaching products of this invention can vary widely depending upon the amount of optional ingredients such as builders, surfactants, and bulking agents. Therefore the actual composition of the products themselves is not considered to be as important as the ratios between the various components and the concentrations of the various components achieved in the laundry solution. Accordingly, the overall compositions and use level will often be expressed in terms of these ratios and these laundry solution concentrations. From these numbers, the amounts of material to be used can be calculated based on a typical laundry liquid volume of 72,000 mL.

The quaternary ammonium salt is present in the bleaching compositions in "an effective active oxygen generation-delaying amount." Such an amount is an amount which when added to (or otherwise made up into) a laundry wash solution yields a concentration of the quaternary ammonium salt which will delay the generation of substantial levels of active oxygen. This amount has the unexpected advantage of increasing the yield of active oxygen as well. Such concentrations can be as low as about 250 mg/L or as high as 3000 mg/L. Preferred effective active oxygen generation-delaying amounts yield concentrations of from about 300 mg/L to about 2500 mg/L with more preferred amounts yielding concentrations of from about 400 mg/L to about 2000 mg/L.

As will be detailed in the examples, levels below about 250 mg/L do not appear to have the desired effect. Levels in the 300 and greater ml/L range give increased yields when sampled after 24 minutes. Higher levels such as 700 mg/ml or greater show increased yields when sampled after 12 minutes.

The amount of peroxygen source is provided to yield a concentration of peroxygen source in the wash liquid of from about 0.0001 to about 0.01 molar, and preferably from about 0.0002 (3 ppm) to about 0.005 molar (80 ppm). The molar ratio of the activator to the peroxygen source can vary, depending upon the number of reactive acyl groups per molecule of the activator, but usually the molar ratio of the two components falls in the range from about 4:1 to about 1:20, preferably from about 2:1 to about 1:8.

The amount of oxygen-sensitive wash aid, when present in the compositions is such as to yield concentrations of from about 1 to about 50 ppm in the wash liquid. When the wash aid is an enzymatic stain remover, it is commonly present at levels to yield concentrations of from about 5 to about 40 ppm in the wash liquid and preferably concentrations of from about 7 to about 30 ppm in the wash liquid. When the wash aid is a fluorescent brightener, it is commonly present at levels to yield concentrations of from about 1 to about 30 ppm in the wash liquid and preferably concentrations of from about 5 to 20 ppm in the wash liquid.

The amount of optional surfactant will depend upon whether or not this composition is to be the sole source of surfactant for the washing. Commonly, surfactant is present in wash liquids at about 750 to 2000 ppm levels and especially about 1000 to 2000 ppm levels. This total amount or some fraction of it can be provided by the present compositions.

The materials of the invention should yield wash solutions having pHs which are alkaline, i.e., pH 7 to 13. Preferably, they yield pHs in the 8 to 13 range and especially in the 9 to 12 range. Buffers, e.g., carbonates, etc., if present, should accommodate these ranges.

Typical overall compositions can comprise

| | |
|---|---|
| Peroxygen material | 5-30% wt. |
| Activator | 5-30% wt. |
| Quaternary ammonium material | 15-45% wt. |
| Builder | 0-75% wt. |
| Peroxygen material | 5-30% wt. |
| Activator | 5-30% wt. |
| Quaternary ammonium material | 15-40% wt. |
| Oxygen-sensitive wash aid | 0.1-5% wt. |
| Builder | 0-70% wt. |
| Peroxygen material | 5-25% wt. |
| Activator | 5-25% wt. |
| Quaternary ammonium material | 20-40% wt. |
| Enzymatic stain remover | 0.2-4% wt. |
| Builder and/or surfactant | 10-~70% wt. |

A variety of specific compositions in accord with this invention are provided in the Examples, as well.

The bleaching compositions of the invention are prepared by admixing the ingredients. When preparing solid combination products containing the bleaching composition in combination with oxygen-sensitive wash aids and/or with surfactants and/or builder salts, the peroxygen compound and activator can be mixed either directly with the wash aid, surfactant, builder, and the like, or peroxygen compound and activator can be separately or collectively coated with a coating material to prevent premature activation of the bleaching agent. The coating process is conducted in accordance with procedures well known in the art. Suitable coating materials include compounds such as magnesium sulfate, polyvinyl alcohol, lauric acid or its salts, and the like.

Typical Use Conditions

The materials of this invention find application in commercial and domestic laundry settings. The materials can be added to the prewash segment, the wash segment or a rinse segment of the overall cycle. Most commonly, it is preferred to add the materials to the wash segment of the cycle.

The conditions of use can include cold water and hot water wash conditions with water temperatures ranging from a low of about 33° F. to about 45° F. to a high of about 200° F. being possible, temperatures of from about 50° F. to about 150° F. being preferred and temperatures of from about 60° F. to about 140° F. being more preferred in a domestic laundry setting. The conditions of use can also include the use of alkaline wash liquid, for example one having a pH of from about 7.5 to about 13 and preferably from about 9 to about 12.

In most laundry cycles, the wash period is from about 8 to about 20 minutes, with wash times of from about 10 to about 15 minutes being most common. It is to be noted that an aspect of this invention is its ability to delay the generation of bleaching levels of active oxygen, for example 6 ppm active oxygen, or greater and especially 8 ppm active oxygen, or greater). The delay is on the order of 3 to 10 minutes. Thus, the segment of the cycle when the composition of this invention is added should be long enough to accommodate this delay and still provide a suitable period for subsequent bleaching action once the active oxygen concentration has risen to effective bleaching levels. The aforesaid wash times will accommodate the delay period and provide a good bleach period, as well.

Since the invention permits a delay in the bleaching action during which sensitive materials may be at work, it is generally the practice to contact the soiled clothes with the wash solution promptly (typically at once or within a minute or two) upon forming the wash solution.

EXAMPLES

This invention will be further illustrated by the following Examples. These are presented to show modes of practicing the invention and are not to be construed as limiting its scope.

EXAMPLE 1

A pair of aqueous laundry liquids are prepared in the laboratory. One is for comparison purposes. It contains a peroxygen source (hydrogen peroxide) at a concentration of 0.0013 molar, an activator (sodium octanoyloxy benzene sulfonate—"SOBS") in a molar ratio relative to the peroxygen source of 1:1.5, 1.52 g/L of a commercial laundry detergent (Tide®) and 1.06 g/L of sodium carbonate. The solution has a pH of 10.5 and a temperature of 72° F.

The second solution, which is a solution prepared in accord with this invention, is identical to the first with the exception that it contains 0.47 g/L of quaternary ammonium salt (lauryl trimethyl ammonium chloride).

As soon as each solution is assembled, samples are periodically drawn and analyzed by iodometric titration. The titration is carried out by adding 10% $H_2SO_4$ and excess potassium iodide and back-titrating with sodium thiosulfate to determine the concentration of active oxygen they contain. The titration method employed is described generally in the text *Oxidation*, Vol. 1, (Marcel Dekker, Inc. New York, 1969) Chapter 5, "Peracid and Peroxide Oxidations" by Sheldon N. Lewis, pages 221, et seq., (incorporated herein by reference) with the modification that the samples are iced before and during titration to eliminate interference from unreacted hydrogen peroxide. From previous experiments it is known that such a solution has a theoretical maximum level of active oxygen from peracid formation of about 14 ppm.

It is observed that in the comparison sample, the active oxygen level is at 8 ppm within 2 minutes and stays between 8 and 9 ppm throughout the test. In contrast, the solution prepared in accord with this invention has lower active oxygen levels (3-4 ppm) for at least 6 minutes after which the levels rise. The level reaches 8 ppm at about 10 minutes and is still rising past 13 ppm at 18 minutes. These results are shown graphically in the figure where line "A" is a curve showing the active oxygen levels of the material of the invention and "Comparative Experiment" is a curve showing the active oxygen levels of the comparative material.

Thus it can be seen that the present invention provides a way to obtain high levels of bleaching from a peroxygen bleach but at the same time delay the onset of the active oxygen generation so as to permit oxidation-sensitive wash aids to be used as well.

EXAMPLE 2

The experiment of Example 1 is repeated with the change that instead of 0.47 g/L of quaternary ammonium salt, 0.94 g/L of quaternary ammonium salt is used. This use level shows the same general effect as observed in Example 1 with the onset of active oxygen being somewhat more rapid. These results are given in the Figure as curve "B".

EXAMPLES 3-5

The experiment of Example 1 is repeated three times with the change that instead of 0.47 g/L of quaternary ammonium salt, 0.045, 0.095, and 0.235 g/L of quaternary ammonium salt are used. The mole ratio of peroxygen material to activator is also varied to 2:1. These use levels show the same general effect as observed in Example 1 with the ultimate levels of active oxygen attained being somewhat lower.

EXAMPLE 6

To demonstrate that the delayed onset of the present invention is the result of the addition of the quaternary ammonium salt, a series of 72° F. test solutions are prepared containing SOBS, hydrogen peroxide, and an additive selected from a quaternary ammonium salt and a range of ionic and nonionic surfactants. Samples are taken after 4 minutes and analyzed for peracid as a measure of their active oxygen levels. Each experiment is run in duplicate. The results of this series of experiments are provided in Table 1. They illustrate that the quaternary ammonium salt depresses the level of active oxygen but that the other materials do not.

TABLE 1

| $[C_8SOBS]$, $\times 10^{-4}$ M | $[H_2O_2]$, $\times 10^{-3}$ M | Additive | [Peracid], $\times 10^{-4}$ M | % Yield |
|---|---|---|---|---|
| 8.76 | 1.31 | Lauryl trimethyl ammonium chloride[1] | 2.94 | 34 |
| " | 1.31 | None | 5.61 | 64 |
| " | 1.74 | " | 6.67 | 76 |
| " | 1.31 | K Palmitate | 5.83 | 66 |
| " | " | K Myristate | 5.69 | 65 |
| " | " | K Stearate | 5.65 | 64 |
| " | " | Lauric Acid | 5.40 | 61 |
| " | " | Octylphenoxypolyethoxy ethanol[2] | 5.56 | 63 |
| " | " | Linear $C_{12}$—$C_{15}$-alcohol ethoxylate sulfonate[3] | 6.11 | 70 |
| " | " | Linear $C_{12}$—$C_{15}$-alcohol ethoxylate sulfonate[4] | 5.71 | 65 |
| " | " | Lauryl dimethylamine oxide[5] | 5.31 | 61 |
| " | " | Sulfated ethoxylated alcohol, Na salt[6] | 5.68 | 65 |
| " | " | Lauryl aryl sulfonate[7] | 5.53 | 63 |

[1]Kodak Chemical
[2]Rohm & Haas
[3]Shell Chemical Co.
[4]Shell Chemical Co.
[5]Continental Chemical Co.
[6]Continental Chemical Co.
[7]Pilot Chemical Co.

EXAMPLE 7

A series of products in accord with this invention are prepared. They have the following compositions:

| | |
|---|---|
| Product C | |
| Sodium perborate monohydrate | 16% wt |
| SOBS | 17% wt |
| Hexadecyl trimethyl ammonium chloride | 35% wt |
| Builder | 38% wt |
| Product E | |
| Sodium perborate monohydrate | 16% wt |
| SOBS | 17% wt |
| Dodecyl trimethyl ammonium chloride | 30% wt |
| Alkaline protease (enzyme) | 0.7% wt |
| Sodium hexametaphosphate | 36% wt |
| Product F | |
| Sodium perborate monohydrate | 16% wt |
| Sodium decanoyloxy benzene sulfonate (activator) | 18% wt |
| Dodecyl trimethyl ammonium chloride | 30% wt |
| Milezyme ® (enzyme) | 1.0% wt |
| Builder | 35% wt |
| Product G | |
| Sodium perborate monohydrate | 16% wt |
| SOBS | 17% wt |
| Hexadecyl trimethyl ammonium chloride | 35% wt |
| Alcalase ® (enzyme) | 0.7% wt |
| Tinopal ® 5BMX (whitener) | 0.5% wt |
| Sodium tripolyphosphate (builder) | 31% wt |

If these products were tested in the manner shown in Example 1 they would exhibit the delayed onset of active oxygen production observed there.

If these products were added to the wash cycle of test washes, they would perform as effective peroxygen bleaches, whitening the test materials and removing stains. Products D and G would be observed to offer the additional advantage of enhanced brightener or whitener or other wash aid performance because these sensitive materials had a substantial period at the beginning of the cycle where the active oxygen level was depressed and could not appreciably interfere.

Products E through H should display enhanced stain removal because the delay in peracid formation allows the hydrolytic enzymes to attack specific stains before degradation due to the peracid.

EXAMPLE 8

A series of bleach compositions are prepared. These materials are tested for active oxygen levels and % recovery of active oxygen when used under laundry conditions (70° F., pH 10.5, 100 ppm $Ca^{+2}/Mg^{+2}$ 3:1, 8.2% Tide detergent, 1.06 g/L $Na_2CO_3$, 0.200 g/L sodium perborate tetrahydrate, i.e., 10.5% active oxygen and 0.282 g/L C8 sodium alkanoyloxy benzene sulfonate ("SOBS"), mole ratio perborate/SOBS=1.5. The levels of quaternary amine were varied by adding various levels of dodecyltrimethylammonium chloride.

Figure 2:
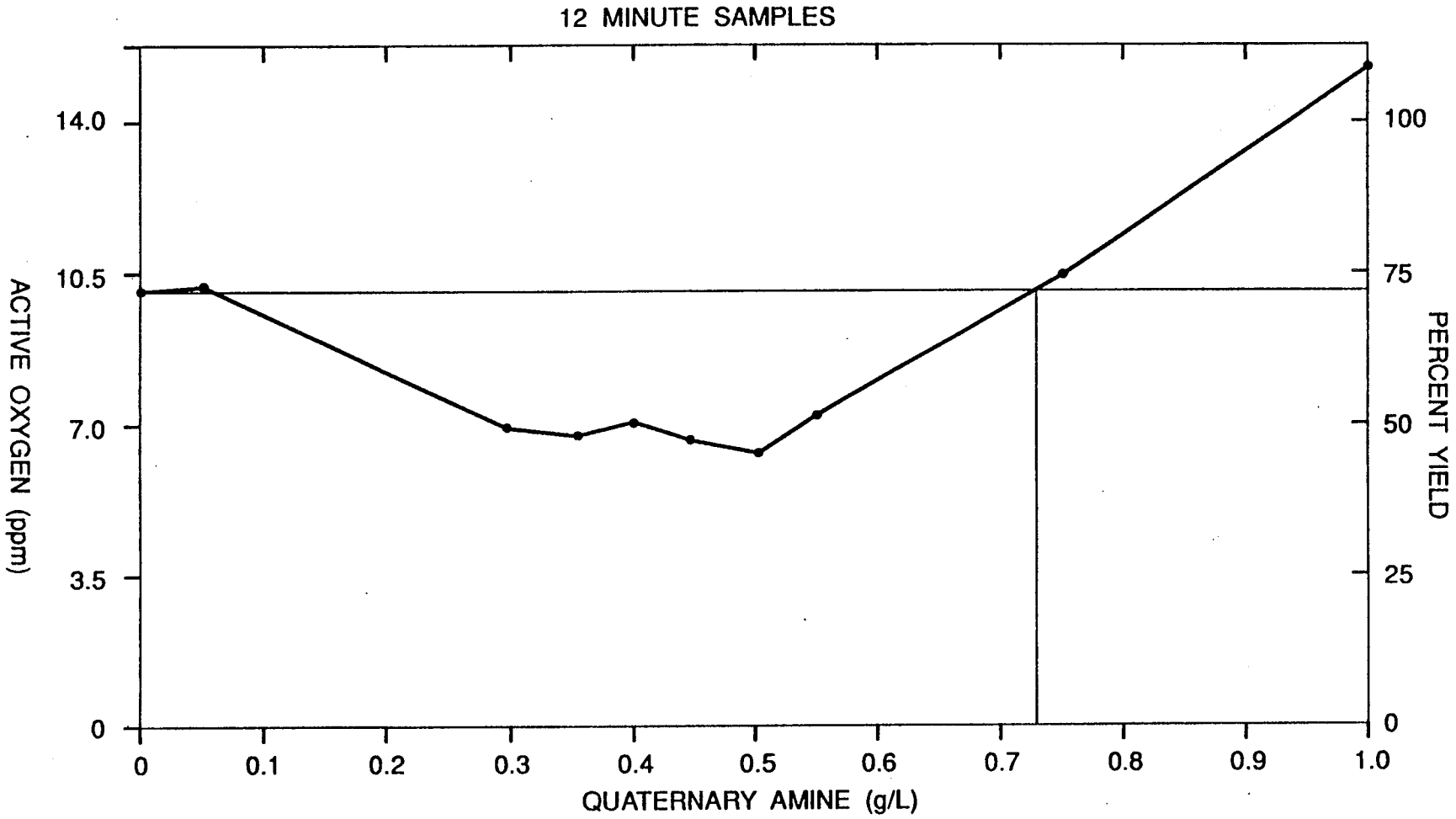
Figure 3:
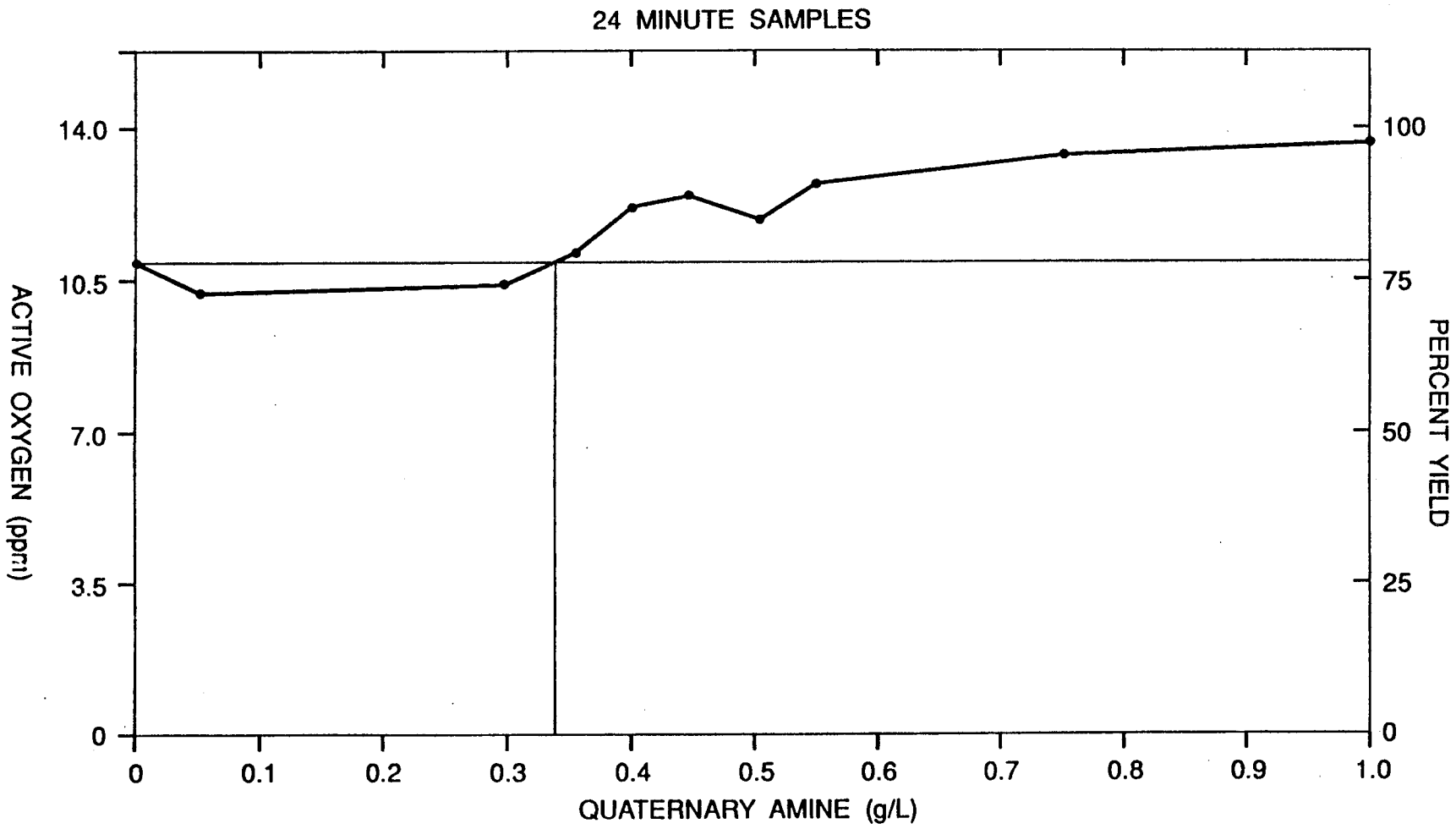

Samples were drawn after 12 and 24 minutes and analyzed for active oxygen levels. The results of the various test are given in Table 2 and are presented graphically in FIGS. 2 and 3. They verify the unexpected result that the quaternary ammonium salt, when added at certain levels, not only delays onset of active oxygen generation, but also gives higher ultimate levels of active oxygen.

TABLE 2

| Run # | Time (min) | Quaternary Ammonium Salt | ppm A.O. | % Recovery |
|---|---|---|---|---|
| 1. | 12 | 0 g | 10.0 | 72 |
| | 24 | | 10.9 | 78 |
| 2. | 12 | .050 g | 10.2 | 73 |
| | 24 | | 10.1 | 73 |
| 3. | 12 | .300 g | 6.8 | 49 |
| | 24 | | 10.5 | 75 |
| 4. | 12 | .350 g | 6.7 | 48 |
| | 24 | | 11.2 | 80 |
| 5. | 12 | .400 g | 7.0 | 50 |
| | 24 | | 12.3 | 88 |
| 6. | 12 | .450 g | 6.5 | 47 |
| | 24 | | 12.5 | 89 |
| 7. | 12 | .500 g | 6.3 | 45 |
| | 24 | | 12.0 | 86 |
| 8. | 12 | .550 g | 7.2 | 51 |
| | 24 | | 12.9 | 92 |
| 9. | 12 | .750 g | 10.3 | 74 |
| | 24 | | 13.6 | 97 |
| 10. | 12 | 1.000 g | 15.2 | 109 |
| | 24 | | 14.0 | 100 |

What is claimed is:

1. A peroxygen laundry bleach composition for use in the presence of oxygen sensitive wash aids, said composition both increasing levels of active oxygen during laundering as well as delaying initial onset of active oxygen generation, said composition comprising a peroxygen source, a surface active or hydrotropic activator therefor in a molar ratio of activator to peroxygen source in the range of 4:1 to about 1:20, and an effective active oxygen generation-delaying amount of quaternary ammonium salt, said effective amount being an amount which provides a quaternary ammonium salt concentration in laundry liquid in the range of from 300 mg/L to about 750 mg/L and said peroxygen source yielding 0.0001 to about 0.01 molar A.O. in the laundry liquid, said quaternary ammonium salt being a $C_{12-16}$ alkyl trimethyl ammonium halide.

2. The composition of claim 1 wherein said quaternary ammonium salt is dodecyltrimethyl ammonium chloride.

3. The composition of claim 1 wherein said quaternary ammonium salt is a hexadecyltrimethyl ammonium chloride.

4. The composition of claim 2 wherein said activator is alkanoyloxybenzene sulfonate with up to 18 carbons in the alkyl group.

5. The composition of claim 4 wherein said activator is sodium dodecanoyloxybenzene sulfonate.

6. A combination laundry product comprising an active-oxygen sensitive wash aid, said wash aid being selected from the group consisting of enzymatic wash aids, fluorescent whitening agents and fragrances combined with a peroxygen laundry bleach composition, said composition both increasing levels of active oxygen during laundering as well as delaying initial onset of active oxygen generation, said composition comprising a peroxygen source, a surface active or hydrotropic active oxygen activator therefor in a molar ratio of activator to peroxygen source in the range of 4:1 to about 1:20, and an effective active oxygen generation-delaying amount of quaternary ammonium salt, said effective amount being an amount which provides a quaternary ammonium salt concentration in laundry liquid in the range of from 300 mg/L to about 750 mg/L, said effective amount initially delaying peracid formation so the wash aid has an initial period in which to act and said peroxygen sources yielding 0.0001 to about 0.01 molar A.O. in the laundry liquid, said quaternary ammonium salt being a $C_{12-16}$ alkyl trimethyl ammonium halide.

* * * * *